United States Patent [19]

Horodysky et al.

[11] Patent Number: 4,568,472

[45] **Date of Patent: * Feb. 4, 1986**

[54] FRICTION REDUCING ADDITIVES AND COMPOSITIONS THEREOF

[75] Inventors: Andrew G. Horodysky, Cherry Hill; Joan M. Kaminski, Clementon, both of N.J.

[73] Assignee: Mobil Oil Corporation, New York, N.Y.

[ * ] Notice: The portion of the term of this patent subsequent to Nov. 3, 1998 has been disclaimed.

[21] Appl. No.: 597,965

[22] Filed: Apr. 9, 1984

Related U.S. Application Data

[62] Division of Ser. No. 265,301, May 20, 1981, Pat. No. 4,478,732.

[51] Int. Cl.[4] ..... C10M 1/54; C10M 1/10

[52] U.S. Cl. ..... 252/49.6; 252/400 R; 548/110; 548/347

[58] Field of Search ..... 252/49.6, 400.41; 548/110, 347

[56] References Cited

U.S. PATENT DOCUMENTS

| | | | |
|---|---|---|---|
| 4,273,665 | 6/1981 | Braid et al. | 252/49.6 |
| 4,298,486 | 11/1981 | Horodysky et al. | 252/49.6 |
| 4,478,732 | 10/1984 | Horodysky et al. | 252/49.6 |

*Primary Examiner*—Jacqueline V. Howard

*Attorney, Agent, or Firm*—Alexander J. McKillop; Michael G. Gilman; Howard M. Flournoy

[57] ABSTRACT

Certain borated additive compounds, such as borated mixed ethoxylated amines and ethoxylated amides or hydroxyalkyl imidazolines and hydroxyesters or hydrolyzed hydroxyalkyl imidazolines and ethoxylated amides and combinations thereof, provide highly effective multifunctional characteristics for various lubricating media into which they are incorporated.

11 Claims, No Drawings

FRICTION REDUCING ADDITIVES AND COMPOSITIONS THEREOF

This is a Divisional of application Ser. No. 265,301, filed May 20, 1981, and now U.S. Pat. No. 4,478,732.

BACKGROUND OF THE INVENTION

1. Field of the Invention

This invention relates to lubricant additives and compositions thereof and, more particularly, to lubricant compositions having multifunctional capabilities comprising oils of lubricating viscosity or greases prepared therefrom containing a minor amount of said multifunctional additive which is derived from various borated mixtures of hydroxyesters, ethoxylated hydrocarbyl amines, ethoxylated hydrocarbyl amides, hydroxyalkyl or hydroxyalkenyl hydrocarbyl imidazolines, or hydrolyzed hydroxyalkyl or hydroxyalkenyl hydrocarbyl imidazolines.

2. Description of the Prior Art

Current there is a serious effort on the part of the automotive industry and the oil industry to provide means for prolonging engine life and reducing the amount of fuel consumed by internal combustion engines. Many solutions have been tried; some strictly mechanical, some have been done with lubricating oils and some have been done by adding friction reducing additives thereto. It has now been found that certain borated mixed hydroxy esters and hydrolyzed hydroxyalkyl or hydroxyalkenyl hydrocarbyl imidazolines; borated mixed hydrolyzed hydroxyalkyl or hydroxyalkenyl hydrocarbyl imidazolines and hydroxyalkyl or hydroxyalkenyl hydrocarbyl imidazolines; borated mixed ethoxylated hydrocarbyl amides and hydrolyzed hydroxyalkyl or hydroxyalkenyl hydrocarbyl imidazolines; borated mixed ethoxylated hydrocarbyl amines and hydrolyzed hydroxyalkyl or hydroxyalkenyl hydrocarbyl imidazolines; borated mixed ethoxylated hydrocarbyl amines and hydroxyesters; borated mixed ethoxylated hydrocarbyl amides and hydroxyesters; borated mixed hydroxyalkyl or hydroxyalkenyl hydrocarbyl imidazoline and hydroxyesters; borated mixed ethoxylated hydrocarbyl amines and ethoxylated hydrocarbyl amides; borated mixed ethoxylated hydrocarbyl amides and hydroxyalkyl or hydroxyalkenyl hydrocarbyl imidazolines; borated mixed ethoxylated hydrocarbyl amines and hydroxyalkyl or hydroxyalkenyl hydrocarbyl imidazolines, and borated mixtures of various such combinations provide multifunctional characteristics that are not obtainable with the individual borated materials or physical mixtures of such borated materials. The borated derivatives disclosed herein provide improved oxidative and thermal stability, volatility, bearing corrosion inhibiting properties and friction reduction relative to the individual borated materials. These borated mixtures are to the best of applicants' knowledge novel and unknown heretofore and thus accordingly have not been previously used in the lubricating art.

SUMMARY OF THE INVENTION

This invention is directed to novel, additive compounds, that is, borates of mixed hydroxy esters, ethoxylated hydrocarbyl amines, ethoxylated hydrocarbyl amides, hydroxyl alkyl or hydroxyalkenyl hydrocarbyl imidazolines, and hydrolyzed hydroxyalkyl or hydroxyalkenyl hydrocarbyl imidazolines in various combinations. In addition to these novel compounds, the invention is also directed to lubricant compositions having significant multifunctional characteristics, such as for example, reduced friction and increased oxidative and thermal stability and to a method of reducing fuel consumption in internal combustion engines by treating the moving surfaces thereof with said compositions.

Description of Specific Embodiments

The generalized structure of the hydroxyalkyl or hydroxyalkenyl hydrocarbyl amides useful herein before boration, is:

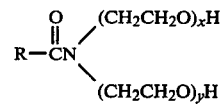

where R usually will contain from about 10 to 30 carbon atoms and is an alkyl or substituted alkyl group which may be primary, secondary or tertiary, straight-chain, branched, or cyclic and may contain one or more double bonds, halogen or one or more sulfur atoms or an aromatic ring. x and y may be the same or different and each is from 1 to about 10, however, the sum of x and y must always be 2 or greater. Propoxylated amides can also be used. A few examples of the above described amide structure include bis(2-hydroxyethyl)oleamide, bis(2-hydroxyethyl)cocoamide, bis(2-hydroxyethyl)-soyamide, bis(2-hydroxyethyl)octadecylamide, polyoxyethylene(5)oleamide, polyoxyethylene(4)cocoamide, polyoxyethylene(5)soyamide, etc.

The generalized structure of the hydroxyalkyl or hydroxyalkenyl hydrocarbyl amines, in accordance herewith before boration, is:

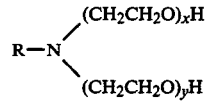

and as stated hereinabove x and y may be the same or different and each is from 1 to about 10, with the proviso that the sum of x and y must be 2 or greater. A non-exhaustive list of examples include bis(2-hydroxyethyl)oleylamine, bis(2-hydroxyethyl)soyamine, bis(2-hydroxyethyl)cocoamine, bis(2-hydroxyethyl)octadecylamine, polyoxyethylene(5)oleylamine, polyoxyethylene(5)soyaamine, polyoxyethylene(4)cocoamine, etc.

The generalized structure of the hydroxyesters, useful herein before boration, is exemplified by the following:

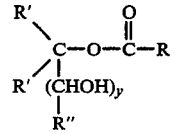

wherein $R' = CH_2OH$, $CH_3$ or H $R'' = CH_2OH$, H, or $CR_2'OCOR$ $y = 1$ to 5

The hydroxy esters must contain at least one free hydroxyl group but may contain two or more. The hydroxy esters may also contain one ester group (as is glycerol monooleate) or more (as is glycerol dioleate). The esters can be used in pure form, or preferably in mixtures such as mixtures of glycerol mono- and dioleate. R is a hydrocarbyl group having from about 10 to about 30 carbon atoms and said hydrocarbyl moiety may be alkyl, straight or branched, cyclic or substituted; and may contain one or more double bonds, halogen or one or more sulfur atoms or aromatic rings and y is 1 to about 5. The hydroxy esters may be made by the reaction of polyhydroxy alcohols with organic acids where glycerol and oleic acid are used in the preparation of glycerol monooleate. Thioglycerol hydroxyesters can also be used.

Sorbitan hydroxyesters and hydroxyesters prepared from trimethylolpropane and pentaerythritol are also useful, e.g., sorbitan monooleate, trimethylolpropane monooleate, trimethylolpropane dioleate, pentaerythritol dioleate monolaurate and the like.

Also useful are hydroxylakyl or hydroxyalkenyl alkyl or alkenylimidazolines and/or hydrolysis products of the imidazoline. The general structure of such compounds can be as described below:

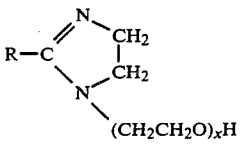

where R is about 10–30 carbon atoms and may be alkyl or alkenyl, arylalkyl, alkyl aryl etc. and x is 1 to 5. Their respective ring-opened hydrolysis products are made by treatment of the above-described imidazolines with at least molar amounts of water and result in structures such as:

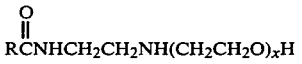

or

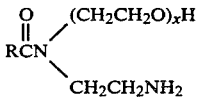

where R and x are defined as above.

The borated derivatives are conveniently produced by the reaction of the selected mixture of compounds with, for example, boric acid, in the presence of a suitable solvent or solvents at temperatures ranging from about 110° C. to about 280° C. Specific reaction conditions and molar equivalents vary with the various reactants and can be readily determined by one of ordinary skill in the art. Besides direct treatment with boric acid other boration procedures several of which are well known in the art can be used, for example, transesterification with a trialkyl borate such as tributyl borate. In any event, the boration procedure generally adopted is conveniently a one-pot, one-step process. the resulting borated mixed materials provided as noted previously are much more effective as friction reducing lubricant additives than their non-borated counterparts or physical mixtures of the individual borated materials. The borated mixed materials possess antioxidant and corrosion inhibiting properties not generally food in the non-borated material and are superior to equivalent physical mixtures of the individual borated materials. The higher molecular weight borated mixtures also appear to be relatively resistant to hydrolysis and retain their multifunctional characteristics even after being in the presence of water at elevated temperatures.

Exemplary mixed borates so prepared are mixed hydroxyalkyl or hydroxyalkenyl hydrocarbyl imidazoline-ethoxylated hydrocarbyl amine borates such as:

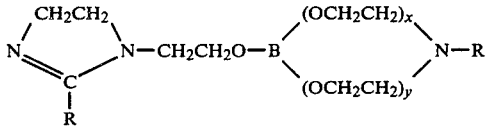

The mixed hydrolyzed hydroxyalkyl or hydroxyalkenyl hydrocarbyl imidazoline-ethoxylated hydrocarbyl amide borates included in the present invention are such as

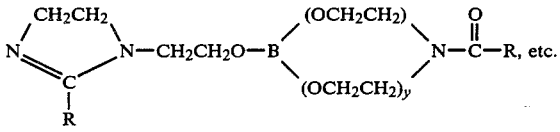

R is defined above.

A generalized structure of useful mixed ethoxylated hydrocarbyl amine-ethoxylated hydrocarbyl amide borates is as follows:

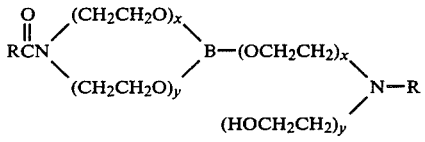

Various similar or related ring-opened borate structures, where R, x, and y are as previously defined above, are also included with all of the mixed borates disclosed hereinabove.

Mixed hydroxyester-ethoxylated hydrocarbyl amine borates such as:

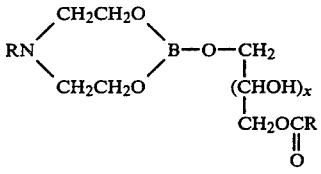

or

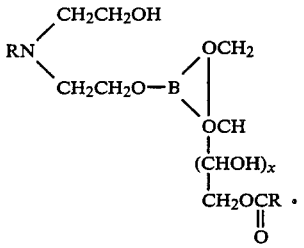

where R is as defined above and the hydroxyesters and ethoxylated hydrocarbyl amines with the structures defined previously, are included in this invention.

For example, mixed trimethylolpropane hydroxyester-hydrolyzed hydroxyalkyl or hydroxyalkenyl hydrocarbyl imidazoline borates can have the following structures:

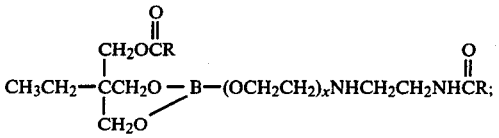

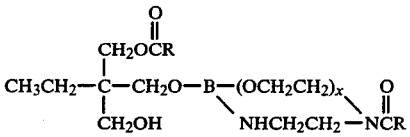

or

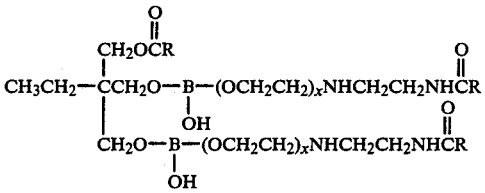

when R and x are as defined above.

The present invention is meant to include as additive compounds all possible borated mixtures of hydroxyesters, ethoxylated hydrocarbyl amines, ethoxylated hydrocarbyl amides, and hydrolyzed or unhydrolyzed hydroxyalkyl or hydroxyalkenyl hydrocarbyl imidazolines in various combinations and proportions.

The amount of additive required to be effective in the lubricant compositions ranges from about 0.1 to about 10% by weight of the total lubricant composition. Preferred is from about 0.5 to 5 wt. %. In general, the additives of this invention may also be used in combination with other additive systems which are used in conventional amounts for their known purposes. The use of additive concentrations of these borated materials in premium quality automotive and industrial lubricants further improves upon such fluids' fuel economy characteristics. The non-metallic compositions described herein useful at said moderate concentrations do not contain any potentially undesirable phosphorus, corrosive sulfur or metallic salts.

The lubricant substrates contemplated for use herein include both mineral and synthetic hydrocarbon oils of lubricating viscosity, mixtures of mineral and synthetic oils, and greases and other solid lubricants prepared therefrom. The synthetic hydrocarbon oils include long chain alkanes such as cetanes and olefin polymers such as trimers and tetramers of octene and decene. These synthetic oils can be mixed with other synthetic oils which include (1) ester oils such as pentaerythritol esters of monocarboxylic acids having 2 to 20 carbon atoms, (2) polyglycol ethers, (3) polyacetals and (4) siloxane fluids. Especially useful among the synthetic esters are those made from polycarboxylic acids and monohydric alcohols. More preferred are the ester fluids made from pentaerythritol, and an aliphatic monocarboxylic acid containing from 1 to 20 carbon atoms, or mixtures of such acids. Lubricant compositions containing the novel friction reducing additives of the present invention can also include additive concentrations of ashless dispersants, detergents, inhibitors, anti-wear, extreme pressure, antifoam, and viscosity improving additives and the like without significantly effecting the performance of the additives in accordance with this invention.

The borated mixtures disclosed herein such as borated mixed ethoxylated amines-ethoxylated amides can be modified by coboration with other boratable species disclosed herein to form novel mixed borates having a novel structure and novel properties not possessed by physical mixtures of the included corresponding borated species. If one coborates an ethoxylated amine and a hydroxy ester to obtain the borated mixture thereof, a structure different from that one obtained when the ethoxylated amine is borated alone and the hydroxy ester is borated alone and then mixed results. A borated mixed ethoxylated amine/ethoxylated amide is very different structurally from a physical mixture of the above individual borates. It was quite surprising that this coboration improved many characteristics; the friction reducing characteristics are improved and the oxidative stability, thermal stability, the anti-rust and anti-corrosion properties of the borated mixtures are also further improved above the individual borated materials.

Having described the invention in general terms, the following are offered as specific illustrations. It is understood that the invention is not thereby limited.

Bis(2-hydroxyethyl)oleamide, bis(2-hydroxyethyl-)oleylamine, Sorbitan monooleate, and 1-(2-hydroxyethyl)-2-heptadecenyl imidazoline used in the examples set out below were obtained commercially but could be synthesized via methods well known in the art.

EXAMPLE 1

Ring Opening Hydrolysis of 1-(2-Hydroxyethyl)-2-Heptadecenyl imidazoline

A mixture of 1-(2-hydroxyethyl)-2-heptadecenyl imidazoline (315 g), water (73.7 g), and n-butanol (123.4 g) was stirred and heated at 96° C. for 4½ hours. The water and butanol were removed by high speed rotary evaporation, and the resulting product was a golden waxy solid. The infrared spectrum of the product contained a strong carbonyl absorption band in the 1640–1650 $cm^{-1}$ region and showed no characteristic imidazoline carbon-nitrogen imido band at 1600 $cm^{-1}$, thereby, indicating complete ring-opening of the starting imidazoline.

EXAMPLE 2

Borated Mixed Hydrolyzed 1-(2-hydroxyethyl)-2-Heptadecenyl Imidazoline and Sorbitan Monooleate Approximately 105 g of hydrolyzed 1-(2-hydroxyethyl)-2-heptadecenyl imidazoline (prepared as described in Example 1), 122 g of sorbitan monooleate, and 106 g of n-butanol were heated to 70° C. in a reactor equipped with a thermometer, an overhead stirrer, and a Barrett trap and condenser for azeotropic distillation. Approximately 30 g of boric acid was charged to the heated reaction solution. In 22 hours 29 ml $H_2O$ distilled over slowly as the reaction temperature increased from 100° to 150° C. The solvent was removed by vacuum distillation, and the borated product was filtered hot through diatomaceous earth to yield a viscous, brown fluid. The infrared spectrum of the product showed no characteristic imidazoline carbon-nitrogen imido band at 1600 $cm^{-1}$, indicating that no recyclization had occurred.

EXAMPLE 3

Borated Mixed Hydrolyzed 1-(2-Hydroxyethyl)-2-Heptadecyl Imidazoline and Bis(2-Hydroxyethyl)Oleamide Approximately 105 g of hydrolyzed 1-(2-hydroxyethyl)-2-hdeptadecenyl imidazoline (prepared as described in Example 1), 103 g of bis(2-hydroxyethyl)oleamide, and 85 g of n-butanol were heated to 60° C. in a reactor equipped as described in Example 2. Approximately 24 g of boric acid was charged to the heated reaction solution. In 18 hours 27 ml $H_2O$ distilled over slowly as the reaction temperature increased from 100° to 145° C. The solvent was removed by vacuum distillation, and the borated product was filtered hot through diatomaceous earth to yield a viscous, brown fluid. The infrared spectrum of the product showed no characteristic imidazoline carbon-nitrogen imido band, indicating that no recylyzation had occurred.

EXAMPLE 4

Borated Mixed Hydrolyzed 1-(2-Hydroxyethyl)-2-Heptadecenyl Imidazoline and Bis(2-Hydroxyethyl)Oleylamine Approximately 106 g of hydrolyzed 1-(2-hydroxyethyl)-2-heptadecenyl imidazoline (prepared as described in Example 1), 104 g of bis(2-hydroxyethyl-)oleylamine, and 85 g n-butanol were heated to 60° C. in a reactor equipped as described in Example 2. Approximately 23 g of boric acid was charged to the heated reaction solution. In about 18 hours 24 ml $H_2O$ distilled over slowly as the reaction temperature increased from 100° to 140° C. The solvent was removed by vacuum distillation and the borated product was filtered hot through diatomaceous earth to yield a clear, brown, liquid product.

EXAMPLE 5

Borated Mixed Bis(2-hydroxyethyl)Oleylamine and Bis(2-hydroxyethyl)Oleamide

Approximately 85 g of bis(2-hydroxyethyl)oleylamine, 85 g of bis(2-hydroxyethyl)oleamide, 75 g toluene solvent and 31 g boric acid were heated to reflux in a reactor equipped as described in Example 2. Approximately 20 ml water was removed by azeotropic distillation at reaction temperatures up to 175° C. over a period of bout 5 hours. The solvent was removed by vacuum distillation at 175° C. and the borated product was filtered hot through diatomaceous earth to yield a clear, brown, liquid product.

EXAMPLE 6

Borated Mixed Bis(2-hydroxyethyl)Oleylamine 1-(2-Hydroxyethyl)-2-Heptadecenyl Imidazoline Approximately 170 g of 1-(2-hydroxyethyl)-2-heptadecenyl imidazoline, 170 g bis(2-hydroxyethyl)oleylamine, 150 g toluene solvent and 62 g boric acid were heated to reflux in a reactor equipped as described in Example 2. Approximately 47 ml water was removed by azeotropic distillation at temperatures up to 175° C. over a period of about 5 hours. The solvent was removed by azeotropic distillation and the borated product was filtered hot through diatomaceous earth to yield a clean, brown, liquid product. Certain of the mixed borated material was then subjected to testing in a low velocity friction apparatus test described below. Test results are reported in Table 1 below.

Low Velocity Friction Apparatus (LVFA)

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 $in.^2$). Both surfaces are submerged in the test lubricant. Friction between the steel surfaces is measured as a function of the sliding speed at a lubricant temperature of 250° F. The friction between the rubbing surfaces is measured using a torque arm strain guage system. The strain gauge output, which is calibrated to be equal to the coefficient of friction, is fed to the Y axis of an X-Y plotter. The speed signal from the tachometer-generator is fed to the X-axis. The minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever cam-motor arrangement.

Procedure

The rubbing surfaces and 12–13 ml. of test lubricant are placed on the LVFA. A 500 psi load is applied, and the sliding speed is maintained at 40 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 40 fpm sliding speed. Freshly polished steel specimens are used for each run. The surface of the steel is parallel ground to 6 to 8 microinches. The percentages by weight are percentages by weight of the total lubricant oil composition, including the usual additive package. The data are percent decrease in friction according to:

$$\frac{(U_k \text{ of oil alone}) - (U_k \text{ of Additive plus oil}) \times 100}{(U_k \text{ of oil alone})}$$

Thus, the corresponding value for the oil alone would be zero for the form of the data used in the Table below.

TABLE 1

FRICTION CHARACTERISTICS

| Example No. | Additive Conc. wt % | Reduction or % Change in Coefficient of Friction 5 ft/min. | 30 ft/min. |
|---|---|---|---|
| Base oil (fully formulated engine oil containing DDI package) | — | 0 | 0 |
| Example 2 | | | |
| Borated Mixed Hydrolyzed 1-(2-hydroxyethyl)-2-hetadecenyl imidazoline and Sorbitan Monooleate | 4 | 21 | 17 |
| Example 3 | | | |
| Borated Mixed Hydrolyzed 1-(2-hydroxyethyl)-2-heptadecenyl imidazoline and | 4 | 21 | 23 |

TABLE 1-continued

FRICTION CHARACTERISTICS

| Example No. | Additive Conc. wt % | Reduction or % Change in Coefficient of Friction 5 ft/min. | 30 ft/min. |
|---|---|---|---|
| Bis(2-hydroxyethyl)oleamide | | | |
| Example 4 | | | |
| Borated Mixed Hydrolyzed 1-(2-hydroxyethyl)-2-heptadecenyl imidazoline and Bis(2-hydroxyethyl)oleylamine | 4 | 43 | 36 |
| Example 5 | | | |
| Borated Mixed Bis(2-hydroxyethyl) Oleylamine and Bis(2-hydroxyethyl) Oleamide | 2 | 16 | 11 |
| Example 6 | | | |
| Borated Mixed Bis(2-hydroxyethyl) Oleylamine and 1-(2-hydroxyethyl)-2-heptadecenyl imidazoline | 1 | 27 | 22 |

Certain of the exemplary additive material was also tested for its copper corrosivity characteristics in accordance with ASTM D130-80.

The data is summarized in Table 2.

TABLE 2

COPPER CORROSIVITY CHARACTERISTICS

| Example No. | Conc in 200' SPN | ASTM D130-80 250° F., 3 hrs. | ASTM D130-80 210° F., 6 hrs. |
|---|---|---|---|
| Example 2 | | | |
| Borated Mixed Hydrolyzed-(2-hydroxyethyl)-(2-heptadecenyl)-imidazoline and sorbitan monooleate | 3<br>1 | 1A<br>1A | 1B<br>1B |
| Example 3 | | | |
| Borated Mixed Hydrolyzed 1-(2-hydroxyethyl)-2-heptadecenyl imidazoline and Bis(2-hydroxyethyl) oleamide | 3<br>1 | 1A<br>1A | 1B<br>1B |
| Example 4 | | | |
| Borated Mixed Hydrolyzed 1-(2-hydroxyethyl)-2-heptadecenyl imidazoline and Bis(2-hydroxyethyl) oleylamine | 3<br>1 | 1A<br>1A | 1A<br>1B |
| Example 5 | | | |
| Borated Mixed Bis(2-hydroxyethyl) oleylamime and Bis(2-hydroxyethyl) oleylamine | 3<br>1 | 1B<br>1B | 1A<br>1A |
| Example 6 | | | |
| Borated Mixed Bis(2-hydroxyethyl) Oleylamine and 1(2-hydroxyethyl)-2-heptadecenyl imidazoline | 3<br>1 | 1A<br>1B | 1A<br>1B |

Certain of the examples were also tested for their antioxidation characteristics in a B-10 catalytic oxidation test at 325° F. for 40 hours. The test lubricant composition is subjected to a stream of air which is bubbled through the composition at a rate of 5 liters per hour at 450° F. for 24 hours. Present in the composition comprising a 200 seconds paraffinic neutral oil in addition to the additive compound were metals commonly used as materials to construct engines namely:

(a) 15.6 sq. in. of sand-blasted iron wire;
(b) 0.78 sq. in. of polished copper wire;
(c) 0.87 sq. in. of polished aluminum wire; and
(d) 0.107 sq. in. of polished lead surface.

The test results are reported below in Table 3.

TABLE 3

Catalytic Oxidation Test 40 hours @ 325° F.

| Example No. | Additive Conc., wt % | Lead Loss mg | % Inc in Visc. of Oxidized Oil using kV @ 100° C. | Neut. Number |
|---|---|---|---|---|
| Base oil, 0% Additive 200"solvent paraffinic Neutral Lubricating Oil | — | −1.2 | 67 | 3.62 |
| Example 2 | | | | |
| Borated Mixed Hydrolyzed 1-(2-hydroxyethyl)-2-heptadecenyl imidazoline and Sorbitan Monooleate | 3<br>1 | 1.9<br>0.6 | 11<br>6 | 2.15<br>1.61 |
| Example 3 | | | | |
| Borated Mixed Hydrolyzed 1-(2-hydroxyethyl)-2-heptadecenyl imidazoline and Bis(2-hydroxyethyl) oleamide | 3<br>1 | 2.7<br>0.6 | 21<br>16 | 3.0<br>2.61 |
| Example 4 | | | | |
| Borated Mixed Hydrolyzed 1-(2-hydroxyethyl)-2-heptadecenyl imidazoline and Bis(2-hydroxyethyl) oleylamine | 3<br>1 | 1.1<br>0.4 | 33<br>15 | 2.96<br>1.96 |
| Example 5 | | | | |
| Borated Mixed Bis(2-hydroxyethyl) Oleylamine and Bis(2-hydroxyethyl) Oleylamine | 3<br>1 | 0<br>0 | 12<br>13 | 1.89<br>1.79 |
| Example 6 | | | | |
| Borated Mixed Bis(2-hydroxyethyl) Oleylamine and 1-(2-hydroxyethyl)-2-heptadecenyl imidazoline | 1 | 0.7 | 29 | 3.35 |

It is understood by one of ordinary skill in the art that modifications and variations from the exemplary material disclosed herein can be readily made and is within the scope of this specification.

We claim:

1. A lubricant composition comprising a major proportion of an oil of lubricating viscosity or grease or other solid lubricant prepared therefrom and a minor amount of a multifunctional additive effective for providing friction reducing, copper anticorrosion, and antioxidant properties to said composition selected from borated mixed hydrolyzed hydroxyalkyl or hydroxyalkenyl hydrocarbyl imidazolines—hydroxyalkyl or hydroxyalkenyl hydrocarbyl imidazolines; and various combinations of these wherein each compound has from about 1 to about 30 carbon atoms and independently contains one or more double bonds and one or more halogen or sulfur atoms or aromatic rings.

2. The composition of claim 1 wherein the additive is borated mixed hydrolyzed hydroxyalkyl or hydroxyalkenyl hydrocarbyl imidazolines and hydroxyalkyl hydrocarbyl imidazolines.

3. The composition of claim 1 wherein the additive is borated mixed hydrolyzed hydroxyalkyl or hydroxyalkenyl hydrocarbyl imidazolines and hydroxyalkenyl imidazolines.

4. The composition of claim 1 wherein said oil is selected from mineral oils, synthetic oils and mixtures thereof.

5. The composition of claim 1 wherein said oil is a synthetic oil.

6. The composition of claim 1 wherein said oil is a mineral oil.

7. The composition of claim 1 wherein said oil is a mixture of synthetic and mineral oils.

8. The composition of claim 1 wherein said major proportion comprises a grease.

9. A method for reducing fuel consumption in an internal combustion engine comprising treating the moving surfaces thereof with a lubricant composition as described in claim 1.

10. A borated additive as described in claim 1.

11. A borated additive as described in claim 2.

* * * * *